US008215187B2

(12) United States Patent
Chen

(10) Patent No.: US 8,215,187 B2
(45) Date of Patent: Jul. 10, 2012

(54) TORQUE DETECTION DEVICE

(75) Inventor: Chiang Kao Chen, Taipei Hsien (TW)

(73) Assignee: Legend Lifestyle Products Corp., Taipei (TW)

( * ) Notice: Subject to any disclaimer, the term of this patent is extended or adjusted under 35 U.S.C. 154(b) by 222 days.

(21) Appl. No.: 12/789,628

(22) Filed: May 28, 2010

(65) Prior Publication Data

US 2011/0107882 A1 May 12, 2011

(30) Foreign Application Priority Data

Nov. 10, 2009 (TW) ..... 98220829 U

(51) Int. Cl.
*B25B 23/14* (2006.01)

(52) U.S. Cl. ..... 73/862.21

(58) Field of Classification Search ... 73/862.21–862.26
See application file for complete search history.

(56) References Cited

U.S. PATENT DOCUMENTS 3,753,625 A * 8/1973 Fabrizio et al. ..... 408/239 R
3,889,490 A * 6/1975 Nadolny ..... 464/23
4,802,540 A * 2/1989 Grabovac et al. ..... 177/211
5,058,439 A * 10/1991 Carpenter ..... 73/862.21
7,082,865 B2 * 8/2006 Reynertson, Jr. ..... 81/479
8,083,596 B1 * 12/2011 Silver et al. ..... 464/31
2006/0236827 A1 * 10/2006 Chiu et al. ..... 81/475
2010/0299084 A1 * 11/2010 Chen ..... 702/41
2012/0006161 A1 * 1/2012 Chen ..... 81/479

* cited by examiner

*Primary Examiner* — Max Noori
(74) *Attorney, Agent, or Firm* — Rosenberg, Klein & Lee

(57) ABSTRACT

A torque detection device includes an enclosure, at least one torque-strain bar, at least one adaptor, a coupler, at least one strain gauge, and a torque display unit. The torque-strain bar is enclosed by the enclosure and has opposite ends respectively forming coupling terminals for coupling with the adaptor and the coupler in either direction. The adaptor is connectable to a torque device, such as a hand tool, an electric tool, or a pneumatic tool. The coupler is connectable to a tool piece, such as a wrench socket. The strain gauge is directly mounted to the torque-strain bar to detect the value of a torque applied thereto and to convert the torque value into a torque value signal, which can be outputted in either wired or wireless manner. The torque display unit is mounted to the enclosure and receives the torque value signal from the stain gauge, whereby the torque display unit may perform displaying of torque value, alarming, and storage according to the torque value signal.

20 Claims, 12 Drawing Sheets

TORQUE DETECTION DEVICE

BACKGROUND OF THE INVENTION

1. Field of the Invention

The present invention relates to a torque detection device, and in particular to a detection device that finds applications in the operation of torque devices and has coupling ends for selectively coupling with various torque devices and tool pieces in opposite directions for performing detection, transmission, displaying, alarming, and storage of an actual value of torque applied thereto.

2. The Related Arts

A hand tool, electrical tool or pneumatic tool, such as a wrench socket or a spanner, is widely used in assembling and maintenance operations of mechanical engineering for tightening or loosening threaded fasteners, such as nuts and bolts, attached to a machine or a mechanical part. However, for high precision machinery, the nuts or bolts must be tightened or loosened by following predetermined operation processes with preset levels of torques. Improper operation of a hand tool, an electrical tool, or a pneumatic tool to apply a torque may inadvertently cause damage or breaking of a threaded fastener or a threaded hole, and may thus lead to undesired damage to the functionality and operation precision of the machine. The conventional hand tools, electric tools, or pneumatic tools are not capable of detecting and displaying the value of a torque applied in an operation, whereby a user cannot get aware of the level of torque applied and must thus depend on his or her experience and discretion to operate the hand tool or electric or pneumatic tool. This may lead to improper application of torque due to human errors. On the other hand, if each hand tool, electric tool, or pneumatic tool is individually provided with a specific torque detector in order to provide torque detectable hand tool, electric tool, or pneumatic tool, then the costs for design and manufacture of the tools must be greatly increased, and this arrangement may not be feasible for all applications where hand tools, electrical tools, and pneumatic tools are used to apply a torque to a workpiece.

Other prior art references in this field are also known. For example, Taiwan Patent No. I300027 discloses a torque wrench having a driving head that is provided with a torque display device, and Taiwan Patent No. I307305 discloses a digital alarm device for torque wrenches. Both Taiwan patents illustrate conventional solutions that mount torque detection/displaying or alarming devices to torque wrenches for the purposes of realizing detection of torque. However, in such known solutions, mounting the torque detection and displaying device to the torque wrench is a difficult operation and this makes the manufacturing of the torque wrench very complicated. Further, both patents provide a solution of torque detection that is only applicable to specific torque wrenches and is not suitable for all kinds of hand tools, electrical tools, and pneumatic tools.

Other prior art references include Taiwan Utility Model No. M367059, which discloses an extender device with digital display for a torque tool. The extender device of this Taiwan Utility Model comprises an extension bar having two ends forming first and second coupling sections respectively. The first coupling section is made in the form of a column-like projection for coupling with for example a wrench socket, while the second coupling section is made in the form of a recessed cavity for coupling with a torque tool, such as a torque wrench, whereby the torque tool may apply a torque to the socket through the extension bar. The extension bar has a connecting section bridging between the coupling ends and forming a machined flat surface to which a sensor is mounted to detect the torque transmitted through the extension bar. The sensor is electrically connected, in a wired manner, to a display unit that shows the detected value of torque.

The structure of the Taiwan Utility Model requires the sensor 20 to be securely attached to the flat face formed on the connecting section of the extension bar in order to properly detect the value of torque. This makes the manufacturing of the extension bar very complicated and also imposes unnecessary constraint to the positioning and mounting of the sensor to the extension bar. Further, it often cause error of detection by using the extension bar that is machined to form the flat face in the connecting section, leading poor performance of torque detection and displaying of the extender device.

In addition, the extension bar illustrated in this Taiwan Utility Model is provided with first and second coupling sections that are of fixed sizes and thus only fit for a torque tool and a socket of given sizes. If tools and sockets of different sizes are desired, then the extension bar must be replaced by different ones. However, due to the sensor that is mounted to the flat face of the connecting section is in wired connection with a circuit board of the display unit, simply replacing the extension bar is not feasible at all. Consequently, extender devices of numerous sizes, which contain extension bars having differently-sized coupling sections, must be prepared in order to carry out operation of tightening and loosening on fasteners of different sizes. This is not economically feasible in view of the costs required.

The first and second coupling sections of the extension bar of the Taiwan Utility Model and the display unit connected thereto allow for only a specific direction use. In other words, a user must distinguish the first coupling section from the second coupling section before he or she can use a torque tool and an associated socket, which can only and respectively connected to the second and first coupling sections and cannot switch with each other. Besides such inconvenience occurring in using the extender device, when the torque tool is set at a given direction, such as the socket being pointed downward, the digits displayed on a display panel of the display unit is visually observable and identifiable, but when the torque tool is set at an opposite direction, such as the socket being pointed upward, the orientation of the digits on the display panel is reversed, making it difficult for a user to read the digits.

In addition, the extender device of the Taiwan Utility Model allows for separation of the extension bar and the display unit. However, when they are spaced from each other, electrical wires are needed to connect the sensor mounted on the extension bar and the circuit board of the display unit in order to transmit the value of torque detected by the sensor to the circuit board of the display unit. Besides the problem mentioned above that the extension bar is only fit for a torque tool of a specific size and an associated socket, this arrangement of wired connection imposes a significant constraint to the operation range of rotation of the tool and the socket, because the wires have only a limited length, which limits the operation space of the tool and the socket connected to the extension bar. Further, the rotation angle of the tool and the socket is also limited and once the rotation is done for an excessive angle, the wires may entangle the extension bar or the wires may detach from the circuit board or the sensor.

SUMMARY OF THE INVENTION

In the known torque wrench provided with torque displaying and the torque tool provided with an extender device with digital display of torque, since the sensor must be mounted to a machined flat face of the extension bar, undesired error of torque detection often occurs and the application thereof is subjected to constraints. Further, each specific extension bar is only fit for a particular size of torque tool and socket, leading to unacceptable economic problems. In addition, the mode of the operation of the display unit only allows for visual access of torque reading in a specific direction, making the user and operation inconvenient in reading the torque value. Further, the sensor of the extension bar and the display unit are connected through wires, which prevent separate use of the extension bar and the display unit.

To overcome the problems and drawbacks of the conventional devices, the present invention provides a torque detection device, which comprises an enclosure, at least one torque-strain bar, at least one adaptor, at least one coupler, at least one strain gauge, and a torque display unit. The toque-strain bar is enclosed by the enclosure and has opposite ends respectively forming coupling terminals for coupling with the adaptor and the coupler in either direction. The adaptor is connectable to a torque device, such as a hand tool, an electric tool, or a pneumatic tool. The coupler is connectable to a tool piece, such as a wrench socket. The strain gauge is directly mounted to the toque-strain bar to detect the value of a torque applied thereto and to convert the torque value into a torque value signal, which can be outputted in either wired or wireless manner. The torque display unit is mounted to the enclosure and receives the torque value signal from the stain gauge, whereby the torque display unit may perform displaying of torque value, alarming, and storage according to the torque value signal.

Further, the strain gauge of the torque detection device of the present invention is connected to at least one wireless data transmitter module that allows the torque value of the torque-strain bar detected by the strain gauge to be transmitted in a wireless manner. The torque display unit comprises at least one wireless data receiver module that receives the torque value of the toque-strain bar transmitted from the wireless data transmitter module in a wireless manner in order to supply the torque value to the torque display unit for displaying.

The effectiveness of the torque detection device of the present invention is that a strain gauge can be directly mounted to a surface of a toque-strain bar without machining a flat face in a surface of an extension bar that is required in the conventional digital displaying type extender device for mounting a sensor. This saves the manufacturing cost and improves operation convenience and preciseness of torque detection. Further, an adaptor and a coupler are provided for mating and connection with torque tools, such as hand tools, electric tools, and pneumatic tools of various specifications and tool pieces of various sizes, so that constraint to the application of the torque detection device to different tools and tool pieces is removed. In addition, the coupling terminals of the torque-strain bar are not subjected to the direction of coupling and allow the adaptor and the coupler to be coupled thereto in either direction, so that a torque tool, such as a hand tool, an electric tool, or a pneumatic tool, and a tool piece, such as a wrench socket, can be conveniently coupled from either direction to facilitate the operation and application thereof. Such a mechanism of coupling to either coupling terminal of the toque-strain bar in either direction allows the torque display unit to be properly positioned without the problem that the conventional extender device limits the display unit to be set at only a given direction, otherwise the data displayed cannot be properly read. Thus, the torque display unit of the present invention can always be readily read no matter whatever angular position the torque tool, such as a hand tool, an electric tool, or a pneumatic tool, and a tool piece are set.

Further, transmission and receipt of data between the stain gauge and the torque display unit can also be done in a wireless manner with a wireless data transmitter module and a wireless data receiver module, whereby the adaptor and the coupler coupled to the ends of the toque-strain bar and the torque tool, such as hand tool, electric tool, or pneumatic tool, and the tool piece, such as wrench socket, respectively connected thereto can be operated without being constrained by the space or orientation of operation and problems of wire entangling or wire breaking can be eliminated. As such, the industrial value and operation performance of the torque detection device can be improved.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENTS

Figure 1:
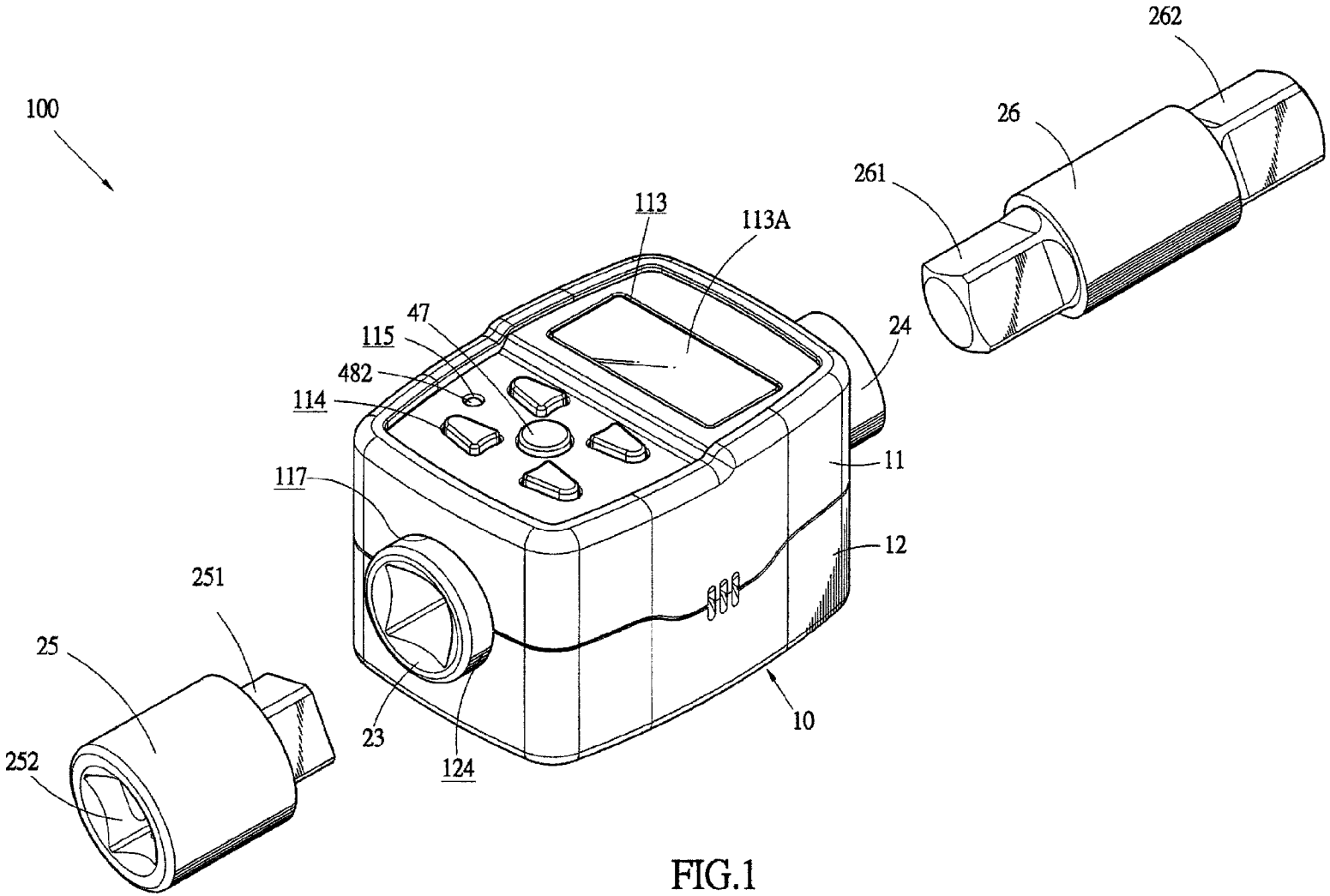
FIG. 1 is a perspective view showing a torque detection device constructed in accordance with a first embodiment of the present invention.
Figure 2:
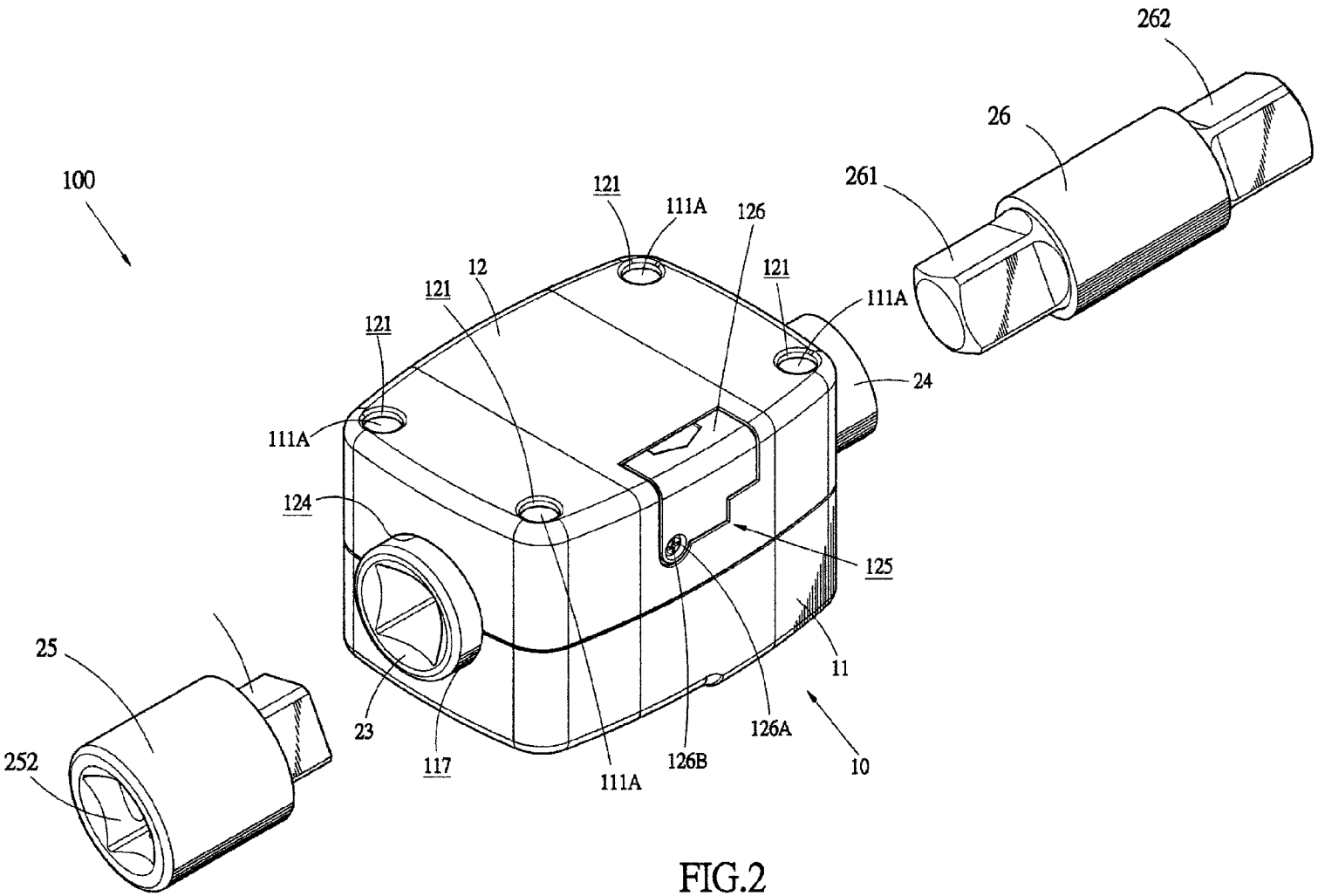
FIG. 2 is also a perspective view of the torque detection device in accordance with the first embodiment of the present invention, but taken at a different perspective.
Figure 3:
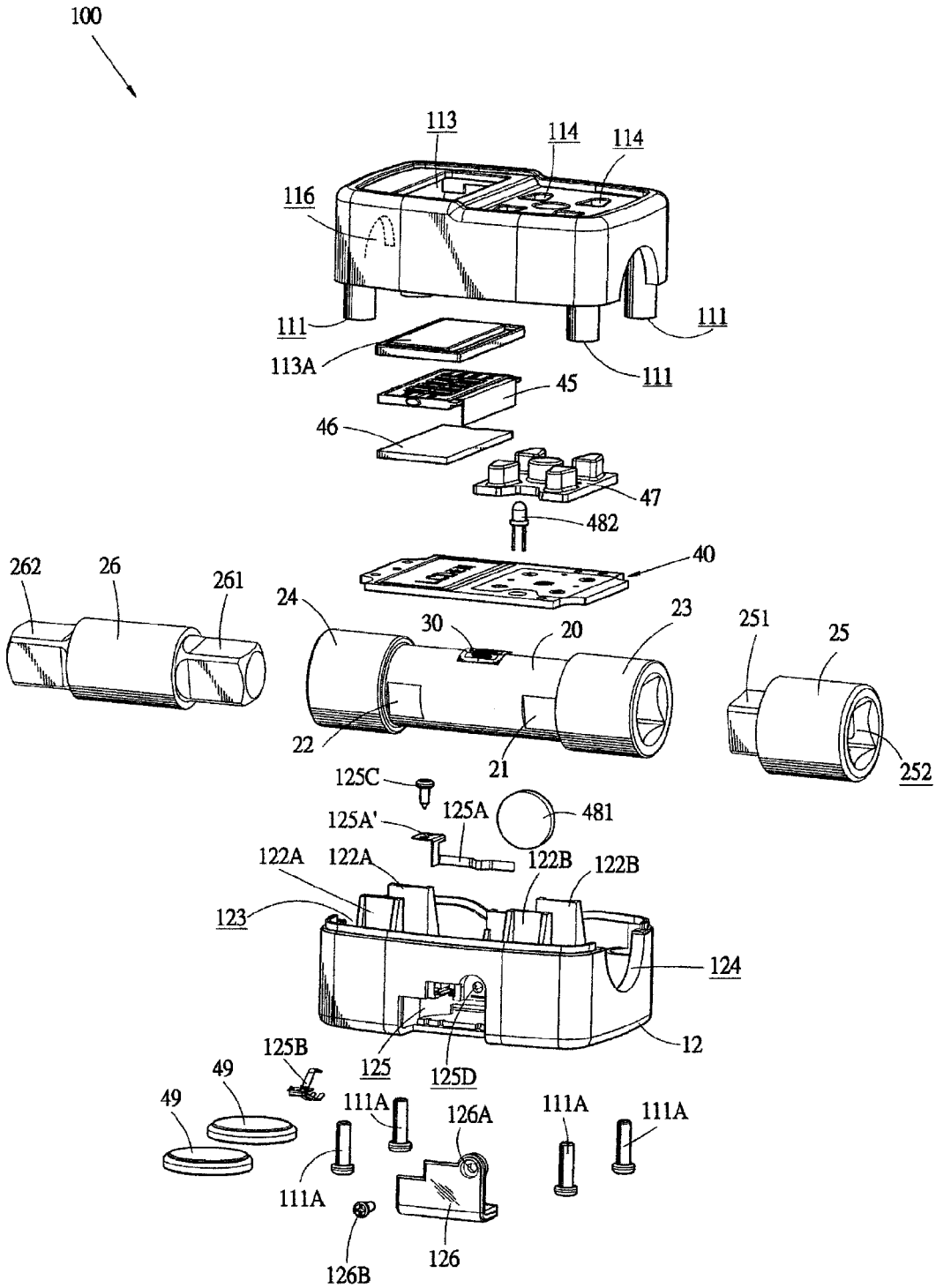
FIG. 3 is an exploded view of the torque detection device in accordance with the first embodiment of the present invention.

With reference to the drawings and in particular to FIGS. 1-3, a torque detection device constructed in accordance with a first embodiment of the present invention is shown at 100. The torque detection device 100 comprises an enclosure 10, which is composed of a first casing member 11 and a mated, second casing member 12. The first casing member 11 forms a plurality of mounting pillars 111 therein, and the second casing member 12 defines a plurality of mounting holes 121 corresponding to and mating the mounting pillars 111 to respectively receive bolts 111A to extend therethrough for fixing the first casing member 11 and second casing member 12 together.

The first casing member 11 defines an internal chamber 112 and the first casing member 11 also forms a display window 113, a plurality of button openings 114, and an alarm opening 115 in a top wall thereof. The display window 113 is an opening to which a transparent panel 113A is mounted. The first casing member 11 has opposite side walls, in which notches 116, 117 are respectively defined.

The second casing member 12 defines an internal chamber 122, in which two pairs of opposing support plates 122A, 122B are formed. The second casing member 12 has opposite side walls, in which notches 123, 124 are respectively defined to correspond to the notches 116, 117 of the first casing member 11. The second casing member 12 also forms on a bottom thereof a power compartment 125, in which two electrode plates 125A, 125B are mounted. The electrode plate 125A has an end that defines a mounting hole 125A' for receiving a bolt 125C that secures the electrode plate 125A in the power compartment 125. The power compartment 125 also forms a threaded hole 125D. The power compartment 125 is covered and closed by a lid 126. The lid 126 defines a through hole 126A that corresponds to the threaded hole 125D. A bolt 126B extends through the through hole 126A and engages the threaded hole 125D to secure the lid 126 to the power compartment 125.

At least one toque-strain bar 20 is provided. The toque-strain bar 20 has a circumferential surface in which at least two pairs of opposite slots 21, 22 are defined to respectively receive the support plates 122A, 122B located in the internal chamber 122 of the second casing member 12 to fit therein so as to fix the toque-strain bar 20 between the support plates 122A, 122B. The toque-strain bar 20 has opposite ends, respectively forming a coupling terminal 23 and a coupling terminal 24. The coupling terminal 23 is received through the notch 117 defined in a side wall of the first casing member 11 and the notch 124 of the second casing member 12, while the coupling terminal 24 is received through the notch 116 defined in a side wall of the first casing member 11 and the notch 123 of the second casing member 12. The coupling terminals 23, 24 are not limited to any specific configuration and type and in an embodiment of the preset invention, both coupling terminals 23, 24 define therein a recessed coupling bore having a square shape, but it is apparent that coupling borers of other shapes are also applicable and deemed within the scope of the present invention.

At least one adaptor 25 is provided. The adaptor 25 has opposite ends respectively forming a first raised coupling section 251 and a recessed coupling cavity 252. The first raised coupling section 251 is configured to couple with either one of the coupling terminals 23, 24 of the toque-strain bar 20. The recessed coupling cavity 252 is connectable to a tool coupling end 210 of a torque device 200 (see FIGS. 8 and 9). The configuration and size of the recessed coupling cavity 252 can be made to be fit for tool coupling ends of torque devices 200 of different specifications.

At least one coupler 26 is provided. The coupler 26 has opposite ends respectively forming a second raised coupling section 261 and a third raised coupling section 262. The second raised coupling section 261 is configured to couple with either one of the coupling terminals 23, 24 of the toque-strain bar 20. The third raised coupling section 262 is connectable to a fitting bore 310 of a tool piece 300 (see FIGS. 8 and 9). The configuration and size of the third raised coupling section 262 can be made to be fit for fitting bores of tool pieces 300 of different specifications.

At least one dual-slope-piece strain gauge 30 is provided. The strain gauge 30 comprises electronic components that perform detection of torque through stress induced deformation. An example is the dual-slope-piece strain gauge of series CF350 available from Xiamen Loadcell Technology Co., Ltd., China. The strain gauge 30 is directly coupled to a cylindrical surface of the toque-strain bar 20 to detect the value of a torque applied to the toque-strain bar 20 and converts the detected torque value into an output of a torque value signal 31 (see FIG. 4).

Figure 4:
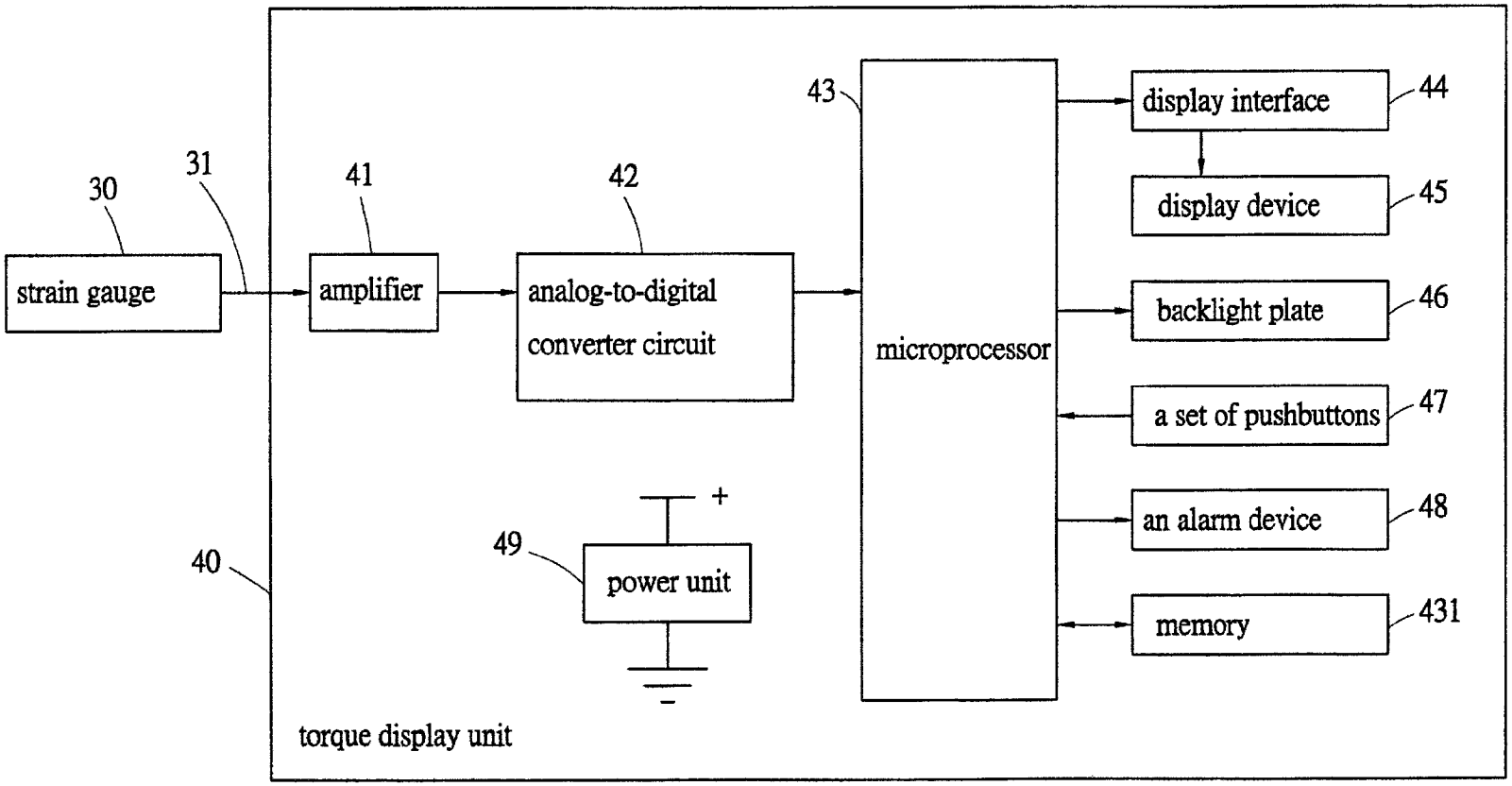
FIG. 4 is a block diagram of a torque display unit of the torque detection device in accordance with the first embodiment of the present invention.

Referring to FIG. 4, a torque display unit 40 is connected to the strain gauge 30 to receive the torque value signal 31 and also provides the functions of displaying of torque value, alarming, and storage. In the first embodiment, the strain gauge 30 and the torque display unit 40 are connected to each other in a wired manner. The torque display unit 40 is not limited to any specific form and in an embodiment of the present invention, the torque display unit 40 comprises at least one amplifier 41, an analog-to-digital converter circuit 42, a microprocessor 43, a display interface 44, a display device 45, a backlight plate 46, a set of pushbuttons 47, an alarm device 48, and at least one power unit 49. The amplifier 41 is connected to the strain gauge 30 to receive and amplify the torque value signal 31. The analog-to-digital converter circuit 42 is connected to the amplifier 41 to convert the amplified torque value signal 31 into digital torque data for output. The microprocessor 43 is connected to the analog-to-digital converter circuit 42 to receive the digital torque data from the analog-to-digital converter circuit 42. The microprocessor 43 provides the operational functions of control of display of torque value, setting of threshold torque value, alarming and storage of torque value. The microprocessor 43 is also connected to a memory 431, which functions to store torque values and a preset threshold torque value.

The display interface 44 is connected to the microprocessor 43 to convert the torque data into a torque value display signal. The display device 45 is connected to the display interface 44 to process and then display the torque value display signal from the display interface 44. The display device 45 is not limited to any specific form and in an embodiment of the present invention, a liquid crystal display (LCD) is taken as an example of the display device 45. It is noted that other display devices, such as light-emitting diode (LED) based display devices, which show equivalent functions, are deemed within the scope of the present invention. The display device 45 is attached to the transparent panel 113A of the display window 113 of the first casing member 11 of the enclosure 10 (see FIG. 3).

The backlight plate 46 is connected to the microprocessor 43 and is arranged behind the display device 45 to provide backlighting to the display device 45.

The pushbuttons 47 are connected to the microprocessor 43 to provide manual access for the operation of the microprocessor 43 in respect of the functions of displaying, alarming, data input, and storage, including for example control and operation commands in connection with switching of units of the torque values displayed, brightness of displaying light from the backlight plate 46, input of threshold torque value for alarming, resetting of alarm, and storage of torque values. The pushbuttons 47 are arranged to respectively and partially project beyond the button openings 114 defined in the first casing member 11 of the enclosure 10 (see FIG. 3) for manual access and operation.

The alarm device 48 is connected to the microprocessor 43. When a detected value of an applied torque reaches a preset threshold torque value, the microprocessor 43 activates the alarm device 48 to give off sound and lighting alarms. The alarm device 48 is resettable by operating the pushbuttons 47 in order to shut down the sound and lighting alarms. The alarm device 48 is not limited to any specific form and in an embodiment of the present invention, the alarm device 48 comprises at least a sound alarm element 481 and at least one lighting alarm element 482 (see FIG. 3). The sound alarm element 481 can be for example a buzzer or a loud speaker. The lighting alarm element 482 may comprise one or more light emitting diodes. Thus, the sound alarm element 481 and the lighting alarm element 482 may realize the functions of alarming with sound and lighting. The sound alarm element 481 is arranged in the internal chamber 122 of the second casing member 12 of the enclosure 10, and the lighting alarm element 482 is received and fixed in the alarm opening 115 of the first casing member 11 of the enclosure 10 to selectively show an alarm through the alarm opening 115.

The power unit 49 supplies a working power to the strain gauge 30, the amplifier 41, the analog-to-digital converter circuit 42, the microprocessor 43, the display interface 44, the display device 45, the backlight plate 46, the pushbuttons 47, and the alarm device 48. The power unit 49 is not limited to any specific form, and in an embodiment of the present invention, a direct current (DC) battery is taken as an example of the power unit 49. The power unit 49 is received in the power compartment 125 of the second casing member 12 of the enclosure 10 with positive and negative terminals of the power unit 49 respectively set in engagement with the electrode plates 125A, 125B that are fixed inside the power compartment 125, whereby the electrode plates 125A, 125B supply electrical power from the positive and negative terminals of the power unit 49 to the strain gauge 30, the amplifier 41, the analog-to-digital converter circuit 42, the microprocessor 43, the display interface 44, the display device 45, the backlight plate 46, the pushbuttons 47, and the alarm device 48.

Figure 5:
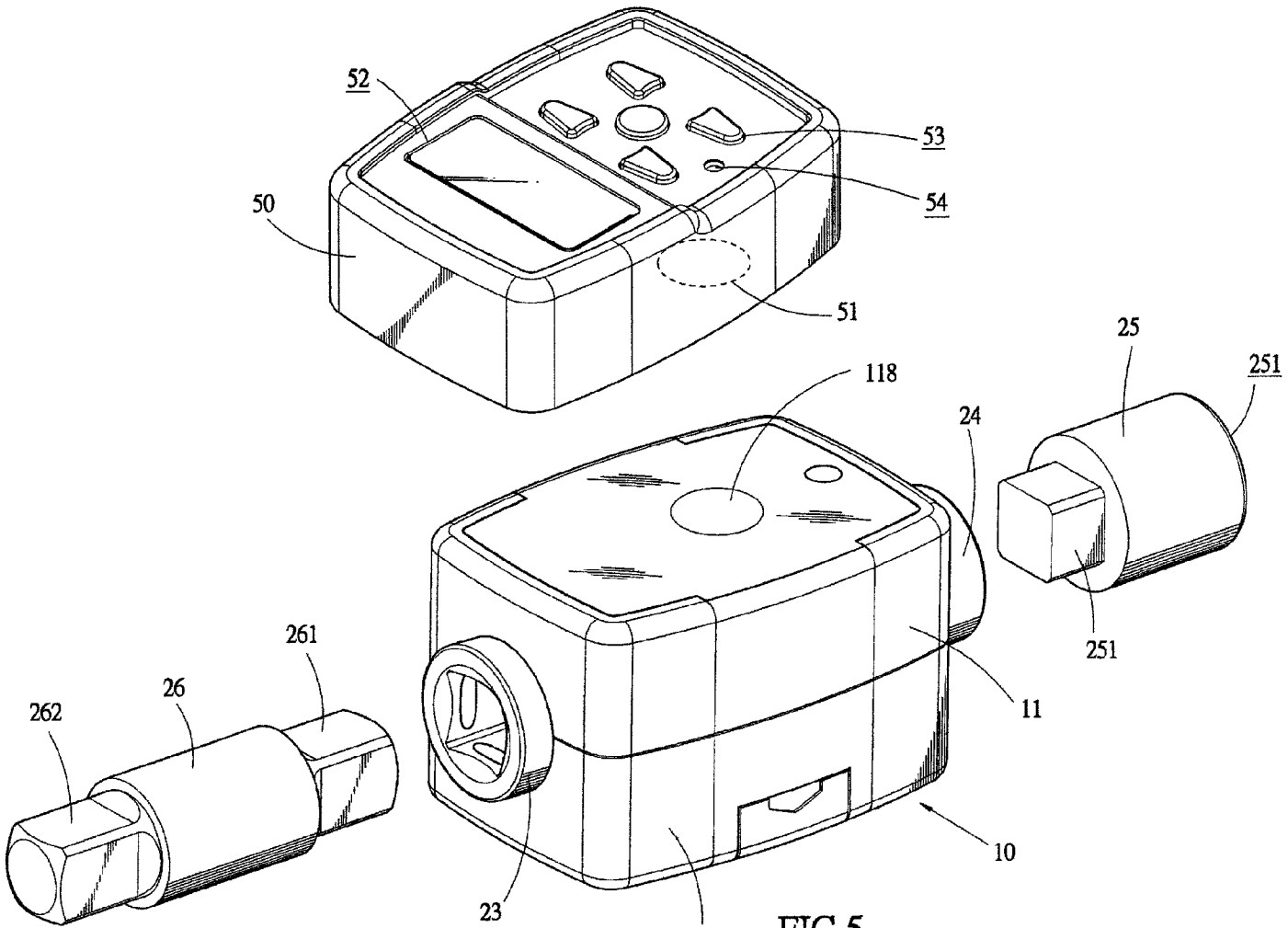
FIG. 5 is a perspective view showing a torque detection device constructed in accordance with a second embodiment of the present invention.
Figure 6:
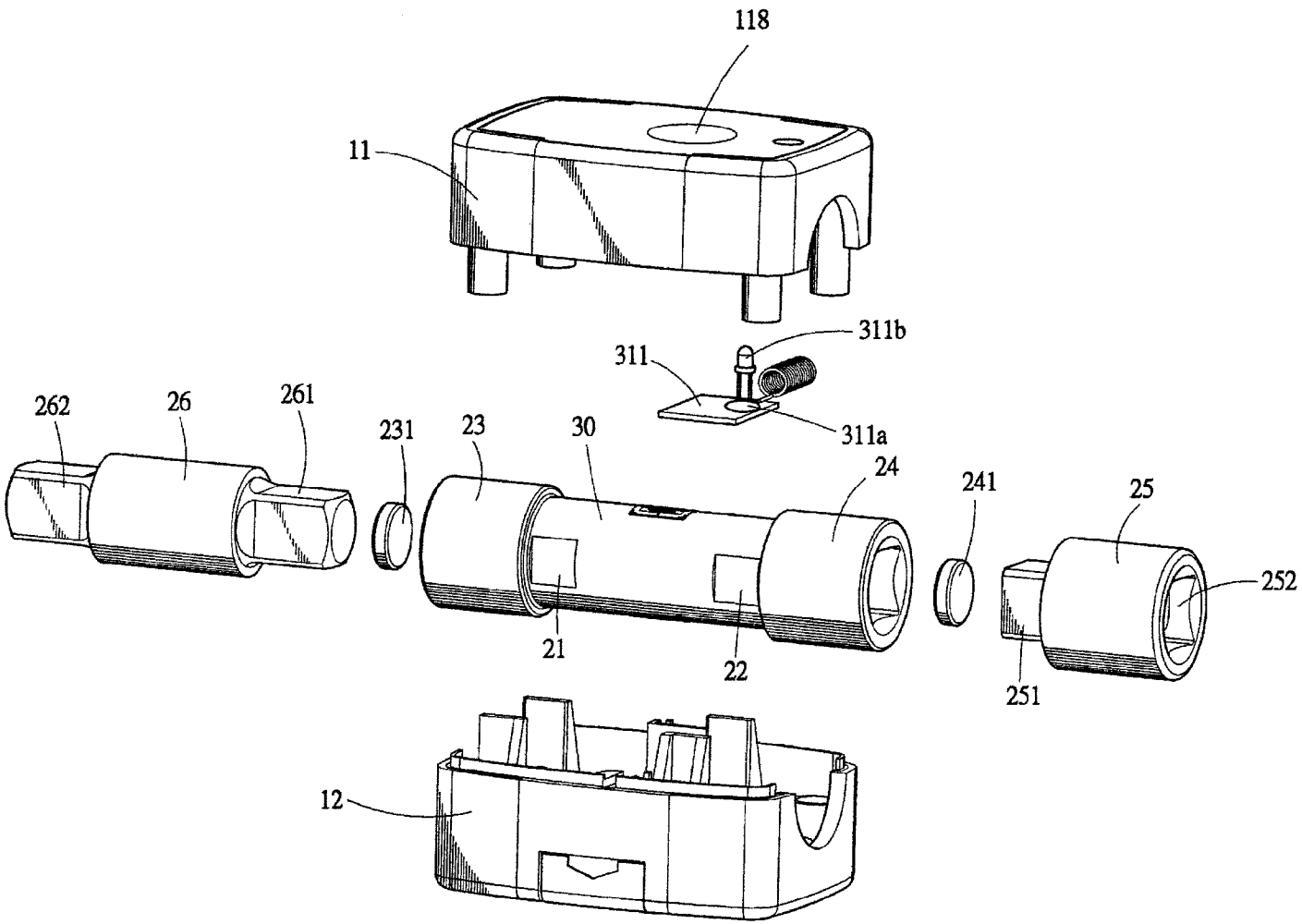
FIG. 6 is an exploded view of the torque detection device in accordance with the second embodiment of the present invention shown in FIG. 5.
Figure 7:
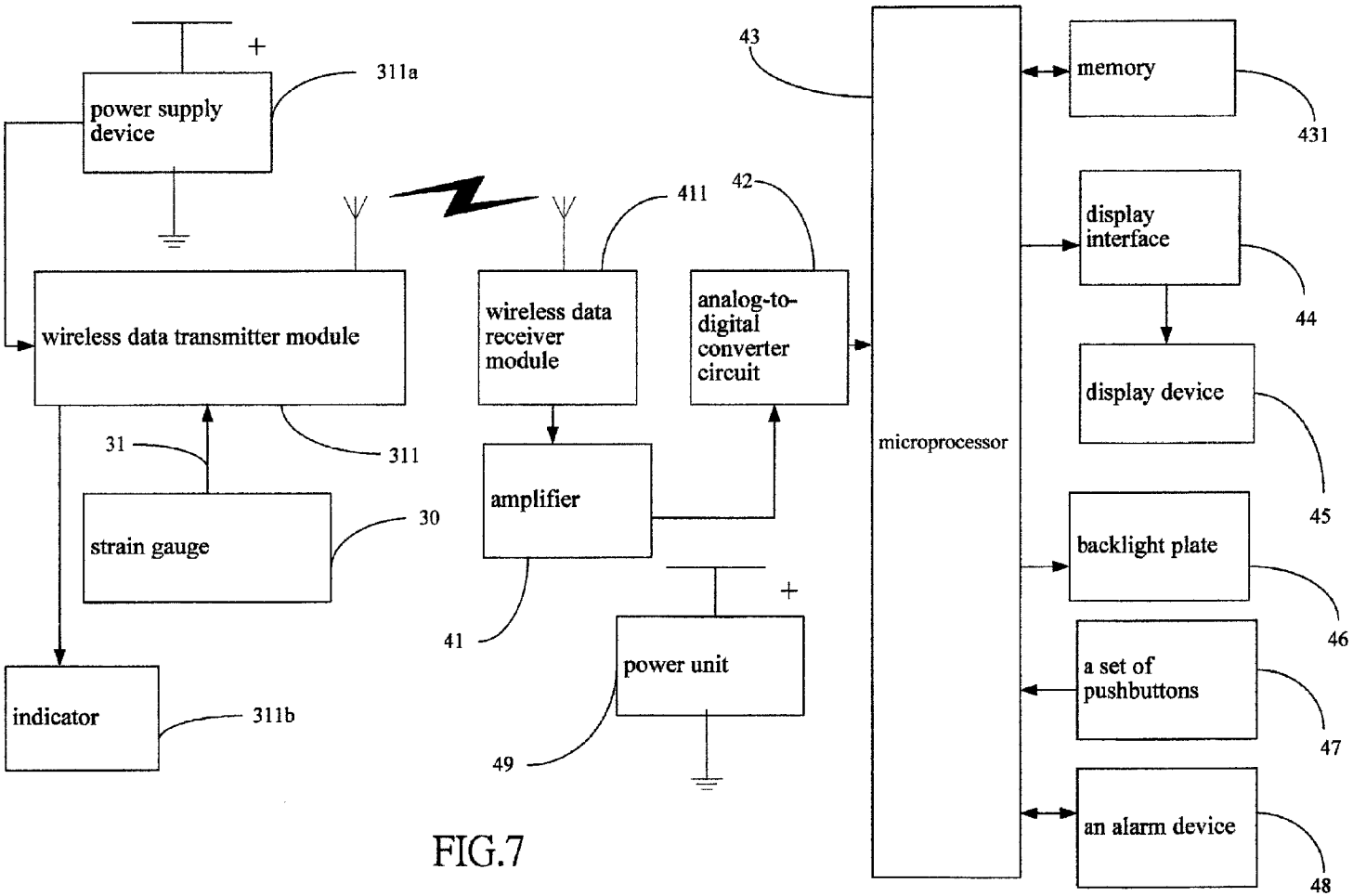
FIG. 7 is a block diagram of a torque display unit of the torque detection device in accordance with the second embodiment of the present invention shown in FIG. 5.

Referring to FIGS. 5-7, a torque detection device constructed in accordance with a second embodiment of the present invention is shown, and is also designated with reference numeral 100 for simplicity. The coupling terminals 23, 24 of the ends of the torque-strain bar 20 respectively receive magnets 231, 241 in the recessed coupling bores thereof to provide magnetic attraction to the first raised coupling section 251 of the adaptor 25 and the second raised coupling section 261 of the coupler 26, whereby the adaptor 25 and the coupler 26 can be more securely and firmly coupled to the coupling terminals 23, 24 of the two ends of the toque-strain bar 20.

In addition, the strain gauge 30 is provided with a wireless data transmitter module 311, whereby the torque value signal 31 supplied from the strain gauge 30 can be transmitted in a wireless manner through the wireless data transmitter module 311. The wireless data transmitter module 311 is connected to a power supply device 311*a* and at least one indicator 311*b*, which respectively provide a working power to the wireless data transmitter module 311 and show a transmission status of the wireless data transmitter module 311. The power supply device 311*a* is not limited to any specific form, and in an embodiment of the present invention, a direct current (DC) battery is taken as an example of the power supply device 311*a*. An example of the indicator 311*b* is an LED.

The toque-strain bar 20, the strain gauge 30, and the wireless data transmitter module 311, the power supply device 311*a* and the at least one indicator 311*b* are collectively arranged between the first casing member 11 and the second casing member 12. The first casing member 11 further comprises at least one connection element 118. The connection element 118 is not limited to any specific form, and in an embodiment of present invention, a magnet is taken as an example of the connection element 118. However, it is noted that other connection elements that show an equivalent function, such as a hook-and-loop fastener or fitting socket, are deemed within the scope of the present invention in this respect.

The torque display unit 40 is housed in an insulation casing 50. The insulation casing 50 has a bottom to which at least one mounting element 51 is attached. The mounting element 51 is not limited to any specific form, and in an embodiment of present invention, a magnet is taken as an example of the mounting element 51 for magnetically and releasably coupling to the connection element 118 of the first casing member 11. The insulation casing 50 forms, in a wall thereof, a display window 52, a plurality of button openings 53, and an alarm opening 54 respectively for the installation of the display device 45 and the pushbuttons 47 of the torque display unit 40 and the lighting alarm element 482 of the alarm device 48.

The amplifier 41 of the torque display unit 40 is connected to at least one wireless data receiver module 411 that receives and applies the torque value signal 31 transmitted, in a wireless manner, from the wireless data transmitter module 311 to the amplifier 41, whereby the amplifier 41 receives and amplifies the torque value signal 31. The subsequent operations of torque value displaying, alarming, and storage are substantially identical to what described above with respect to torque display unit 40 of FIG. 4 and repeated description is omitted. The torque-strain bar 20 and the strain gauge 30 can be selectively connected to or detached from the torque display unit 40 through the releasable coupling between the connection element 118 and the mounting element 51 so that they can be used as individually, wherein the transmission and receipt of the torque value signal 31 are done in a wireless manner, making a torque device 200 and a tool piece 300 that are respectively coupled to the adaptor 25 and the coupler 26 connected to the coupling terminals 23, 24 of the torque-strain bar 20 operating in a constraint-free manner in tightening or loosening fasteners without being affected by any particular space or angle of operation.

The wireless transmission and receipt mode between the wireless data transmitter module 311 and the wireless data receiver module 411 is not limited to any specific mode and in an embodiment of the present invention, wireless radio frequency application is taken as an example. Other modes of wireless transmission and receipt modes, such as wireless USB (Universal Serial Bus), Blue Tooth, infrared, amplitude shift keying (ASK) or frequency shift keying (FSK), are deemed within the scope of the present invention.

Figure 8:
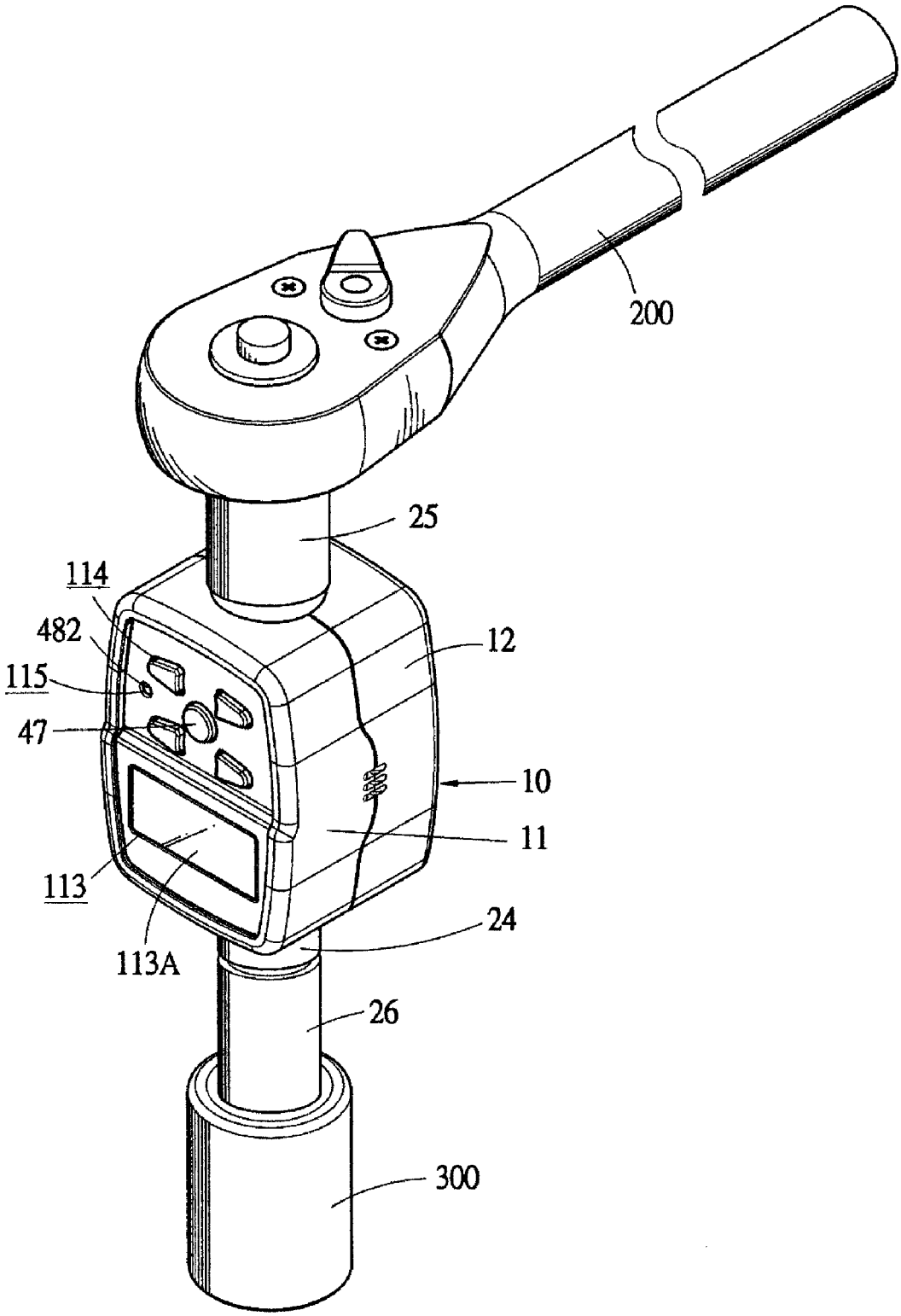
FIG. 8 is a perspective view illustrating an application of the torque detection device of the present invention.
Figure 9:
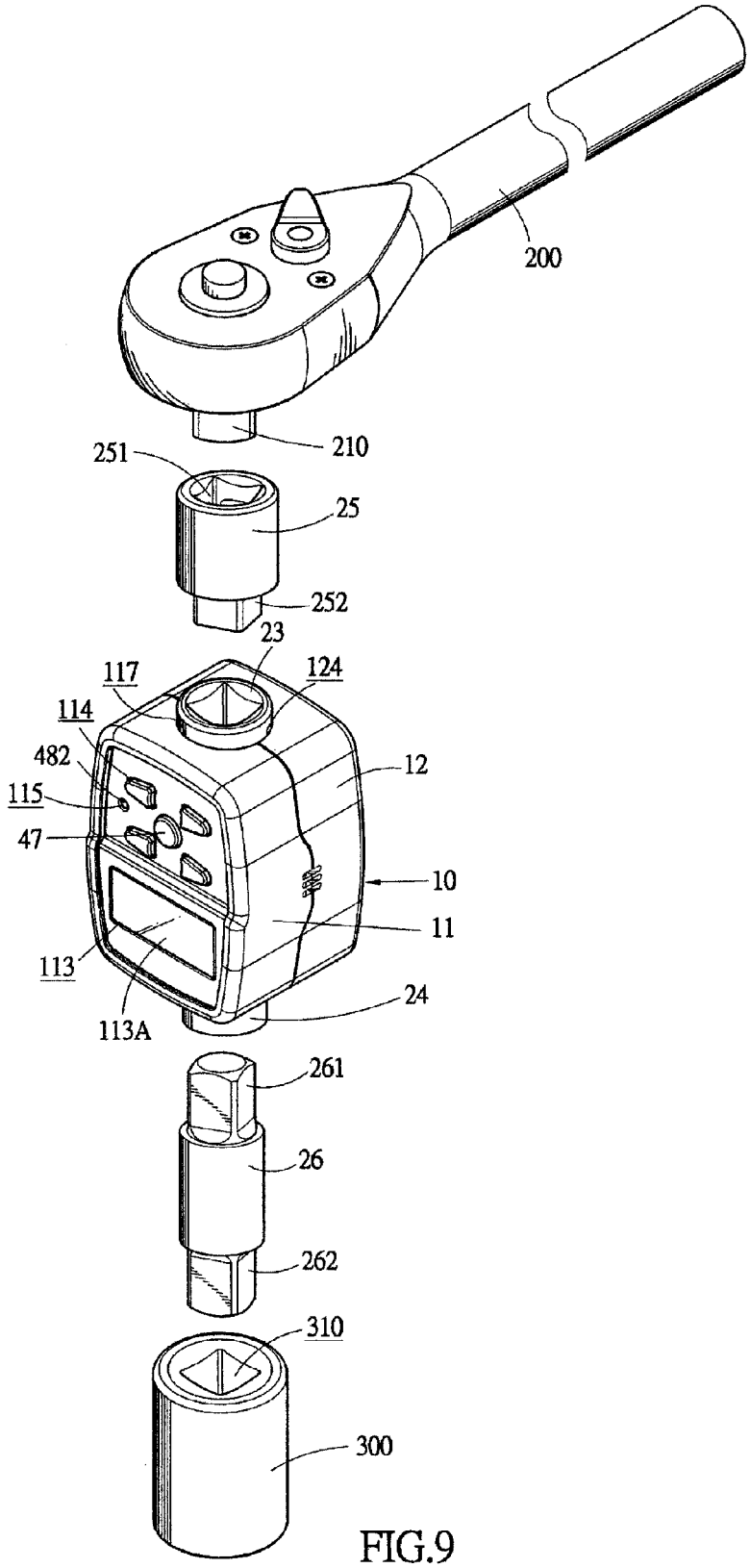
FIG. 9 is an exploded view of FIG. 8.

Referring to FIGS. 8 and 9, an application of the torque detection device 100 according to the present invention is illustrated. The coupling terminal 23 of the torque-strain bar 20 is connected to a tool coupling end 210 of a torque device 200 through the adaptor 25, and the coupling terminal 24 is connected to a fitting bore 310 of a tool piece 300 through the coupler 26. The torque device 200 can be for example a hand tool, an electrical tool, or a pneumatic tool, which functions as a device that generates a torque source. In an embodiment of the present invention, a torque wrench is taken as an example of the torque device 200, and an example of the tool piece 300 is a wrench socket.

The operation of the torque device 200 provides a twisting torque to drive the tool piece 300 for tightening or loosening for example a nut. During the operation, the strain gauge 30 mounted to the toque-strain bar 20 detects and provides an output of the torque generated by the operation of the torque device 200 as a torque value signal 31 to the torque display unit 40 in either a wired manner or a wireless manner as discussed above. Thus, based on the torque value signal 31, the torque display unit 40 selectively proceeds with desired operations of displaying, alarming, and storage. In other words, the torque value is displayed on the display device 45, and when the torque value reaches a threshold set in advance by a user, the sound alarm element 481 and the lighting alarm element 482 of the alarm device 48 respectively give off sound alarms and lighting alarms to allow the user to be timely notified of the alarm and to adjust the torque applied by the torque device 200.

Figure 10:
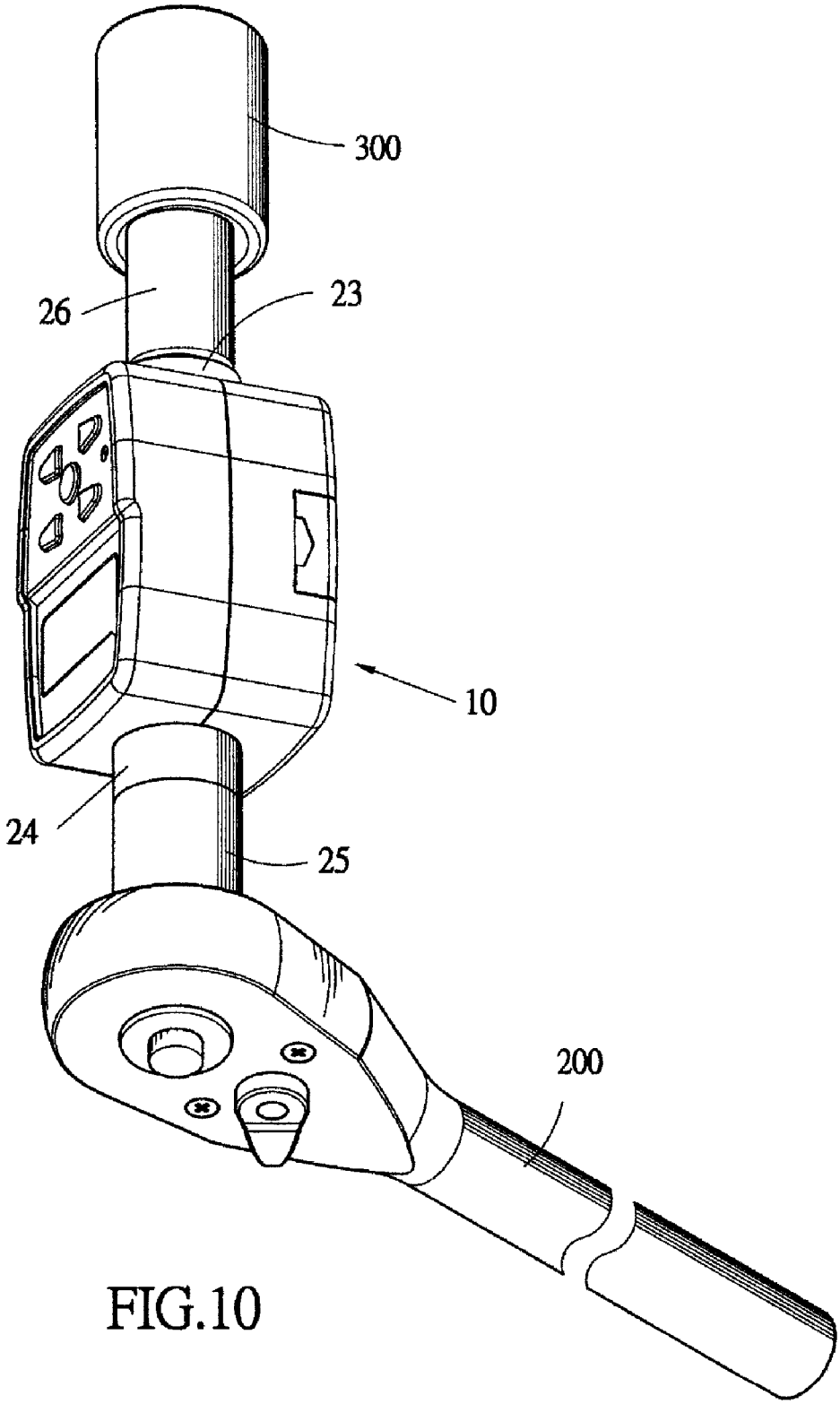
FIG. 10 is a perspective view illustrating another application of the torque detection device of the present invention.
Figure 11:
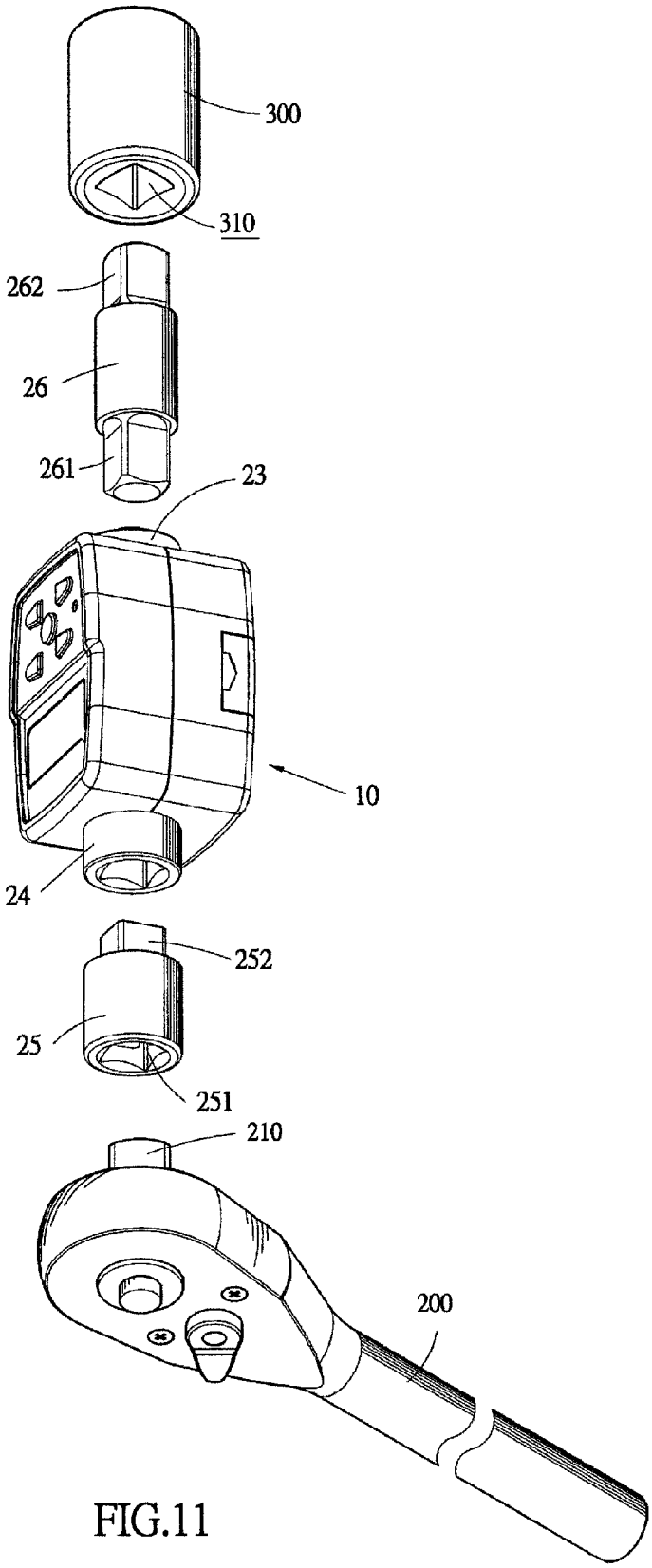
FIG. 11 is an exploded view of FIG. 10.

Referring to FIGS. 10 and 11, another application of the torque detection device 100 according to the present invention is illustrated, wherein the direction of arrangement and operation of the torque device 200 and the tool piece 300 is exactly opposite to what shown in FIGS. 8 and 9. The coupling terminals 23, 24 of the toque-strain bar 20 allow the adaptor 25 to which the torque device 200 is coupled and the coupler 26 to which the tool piece 300 is coupled to be connected to the toque-strain bar 20 in a reversed manner. In this way, the display device 45 of the torque display unit 40 can be maintained at a correct direction to allow the reading of torque to be easily and readily inspected by a user.

Figure 12:
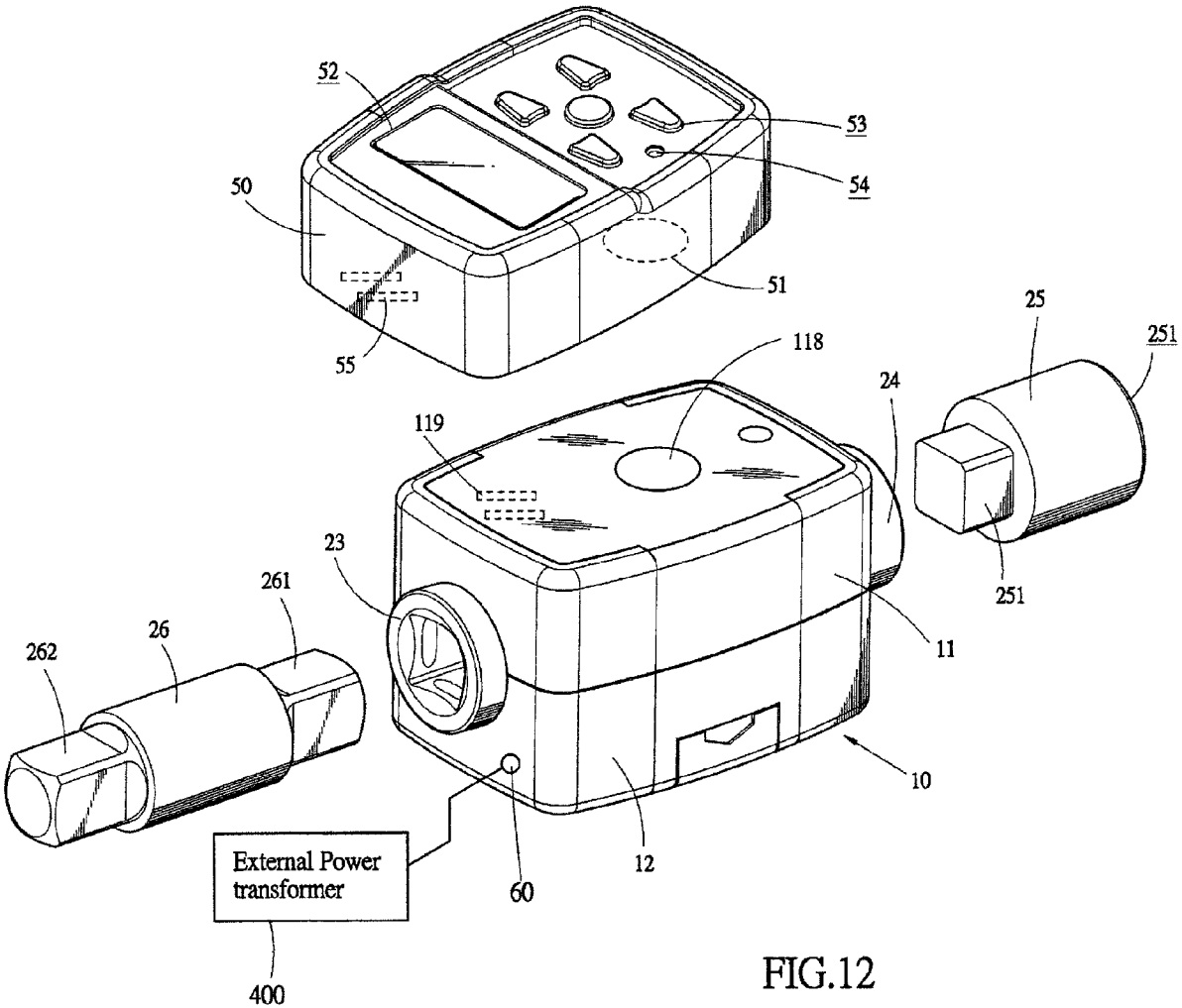
FIG. 12 is a perspective view showing a torque detection device constructed in accordance with a third embodiment of the present invention.

Referring to FIG. 12, which shows a torque detection device constructed in accordance with a third embodiment of the present invention, the torque detection device of the third embodiment, which is also designated with reference numeral 100, comprises a structure similar to that shown in FIGS. 5 and 6, but the enclosure 10 forms at least one charging connector 60 and the first casing member 11 is provided with a plurality charging contacts 119. The charging connector 60 is connectable to an external power transformer 400 to receive a desired direct current therefrom. The charging contacts 119 and the power supply device 311*a* are electrically connected to the charging connector 60 to receive power therefrom. Further, the insulation casing 50 that houses the torque display unit 40 forms, in a bottom thereof, a plurality of charging pads 55 that is connected to the power unit, whereby when the insulation casing 50 is attached to the first casing member 11 of the enclosure 10 through the coupling between the mounting element 51 and the connection element 118, the charging pads 55 are respectively set to correspond to and engage the charging contacts 119 to allow the direct current from the charging connector 60 to be charged to the power unit 49. In other words, the power supply device 311*a* and the power unit 49 can be charged simultaneously.

The torque detection devices as described above with reference to FIGS. 1-12 provide illustrative examples of the technical solution and measures taken by the present invention and it is noted that the idea of the present invention can be embodied in different forms and is not limited to the description given above. Thus, although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A torque detection device, comprising:

an enclosure, which forms an internal chamber and having opposite side walls each defining a passage;

at least one torque-strain bar, which is received in the internal chamber of the enclosure and has opposite end sections forming coupling terminals respectively received through the passages defined in the opposite side walls of the enclosure to project outside the enclosure for selectively receiving an external torque and coupling with tool piece to which the torque is to be applied;

at least one adaptor, which has opposite ends respectively forming a first raised coupling section and a recessed coupling cavity, the first raised coupling section being selectively coupleable with a first one of the coupling terminals of the torque-strain bar, the recessed coupling cavity being adapted to connect to a tool coupling end of a torque device;

at least one coupler, which has opposite ends respectively forming a second raised coupling section and a third raised coupling section, the second raised coupling section being selectively coupleable with a second one of the coupling terminals of the torque-strain bar, the third raised coupling section being adapted to connect to a fitting bore of the tool piece;

at least one strain gauge, which is directly mounted to a surface of the toque-strain bar to detect the torque applied to the torque-strain bar and to convert the torque into a torque value signal; and at least one torque display unit, which is received in the internal chamber of the enclosure and is connected to the strain gauge to receive the torque value signal for performing displaying of torque value, alarming, and storage in respect of the torque value signal.

2. The torque detection device as claimed in claim 1, wherein the enclosure comprises a first casing member and a second casing member mating each other.

3. The torque detection device as claimed in claim 2, wherein the first casing member and the second casing member both form an internal space therein.

4. The torque detection device as claimed in claim 1, wherein the torque display unit comprises:

at least one amplifier, which is connected to the strain gauge to receive and amplify the torque value signal;

at least one analog-to-digital converter circuit, which is connected to the amplifier to convert the torque value signal that has been amplified by the amplifier into digital torque data;

at least one microprocessor, which is connected to the analog-to-digital converter circuit to receive the digital torque data from the analog-to-digital converter circuit, the microprocessor providing functions of control of display of torque, setting a threshold torque value, alarming and storage of torque;

at least one display interface, which is connected to the microprocessor to convert the torque data into a torque value display signal;

at least one display device, which is connected to the display interface to process and then display the torque value display signal from the display interface;

at least one backlight plate, which is connected to the microprocessor to provide backlighting to the display device;

at least one group of pushbuttons, which is connected to the microprocessor to provide manual access for operations of the microprocessor in respect of displaying, alarming, data input, and storage;

at least one alarm device, which is connected to the microprocessor to be actuated by the microprocessor to give off sound and lighting alarms at the time when a detected value of torque reaches a preset threshold torque value; and at least one power unit, which supplies working power to the strain gauge, the amplifier, the analog-to-digital converter circuit, the microprocessor, the display interface, the display device, the backlight plate, the pushbuttons, and the alarm device.

5. The torque detection device as claimed in claim 4, wherein the microprocessor is connected to a memory.

6. The torque detection device as claimed in claim 4, wherein the display device comprises a liquid crystal display.

7. The torque detection device as claimed in claim 4, wherein the backlight plate is arranged behind the display device.

8. The torque detection device as claimed in claim 4, wherein the alarm device comprises at least one sound alarm element and at least one lighting alarm element.

9. The torque detection device as claimed in claim 8, wherein the sound alarm element comprises a buzzer.

10. The torque detection device as claimed in claim 8, wherein the sound alarm element comprises a loud speaker.

11. The torque detection device as claimed in claim 8, wherein the lighting alarm element comprises a light-emitting diode.

12. The torque detection device as claimed in claim 4, wherein the power unit comprises a direct current battery.

13. A torque detection device, comprising:

an enclosure, which forms an internal chamber and having opposite side walls each defining a passage;

at least one torque-strain bar, which is received in the internal chamber of the enclosure and has opposite end sections forming coupling terminals respectively received through the passages defined in the opposite side walls of the enclosure to project outside the enclosure for selectively receiving an external torque and coupling with tool piece to which the torque is to be applied;

at least one adaptor, which has opposite ends respectively forming a first raised coupling section and a recessed coupling cavity, the first raised coupling section being selectively coupleable with a first one of the coupling terminals of the torque-strain bar, the recessed coupling cavity being adapted to connect to a tool coupling end of a torque device;

at least one coupler, which has opposite ends respectively forming a second raised coupling section and a third raised coupling section, the second raised coupling section being selectively coupleable with a second one of the coupling terminals of the torque-strain bar, the third raised coupling section being adapted to connect to a fitting bore of the tool piece;

at least one strain gauge, which is directly mounted to a surface of the toque-strain bar to detect the torque applied to the torque-strain bar and to convert the torque into a torque value signal, the strain gauge being connected to at least one wireless data transmitter module that transmits the torque value signal in a wireless manner; and at least one torque display unit, which is housed in an insulation casing, the torque display unit being connected to at least one wireless data receiver module that receives the torque value signal from the wireless data transmitter module in a wireless manner to allow the torque display unit to perform displaying of torque value, alarming, and storage in respect of the torque value signal.

14. The torque detection device as claimed in claim 13, wherein the first casing member of the enclosure comprises at least one connection element.

15. The torque detection device as claimed in claim 14, wherein the connection element comprises a magnet.

16. The torque detection device as claimed in claim 13, wherein the first casing member of the enclosure forms a plurality of charging contacts.

17. The torque detection device as claimed in claim 13, wherein the enclosure forms a charging connector.

18. The torque detection device as claimed in claim 13, wherein the wireless data transmitter module connected to the strain gauge is connected to at least one power supply device and at least one indicator.

19. The torque detection device as claimed in claim 13, wherein the insulation casing of the torque display unit has a bottom forming a plurality of charging pads.

20. The torque detection device as claimed in claim 13, wherein the torque display unit comprises:

at least one amplifier, which is connected to the wireless data receiver module that receives the torque value signal in a wireless manner, in order to receive and amply the torque value signal;

at least one analog-to-digital converter circuit, which is connected to the amplifier to convert the torque value signal that has been amplified by the amplifier into digital torque data;

at least one microprocessor, which is connected to the analog-to-digital converter circuit to receive the digital torque data from the analog-to-digital converter circuit, the microprocessor providing functions of control of display of torque, setting a threshold torque value, alarming and storage of torque;

at least one display interface, which is connected to the microprocessor to convert the torque data into a torque value display signal;

at least one display device, which is connected to the display interface to process and then display the torque value display signal from the display interface;

at least one backlight plate, which is connected to the microprocessor to provide backlighting to the display device;

at least one group of pushbuttons, which is connected to the microprocessor to provide manual access for operations of the microprocessor in respect of displaying, alarming, data input, and storage;

at least one alarm device, which is connected to the microprocessor to be actuated by the microprocessor to give off sound and lighting alarms at the time when a detected value of torque reaches a preset threshold torque value; and at least one power unit, which supplies working power to the strain gauge, the amplifier, the analog-to-digital converter circuit, the microprocessor, the display interface, the display device, the backlight plate, the pushbuttons, and the alarm device.

* * * * *